US007958765B2

(12) United States Patent
Baba et al.

(10) Patent No.: US 7,958,765 B2
(45) Date of Patent: Jun. 14, 2011

(54) PRESSING MACHINE WITH DIE CUSHION DEVICE

(75) Inventors: Kiyokazu Baba, Komatsu (JP); Hiroaki Honma, Komatsu (JP); Masahide Sunata, Komatsu (JP); Hajime Yoshida, Komatsu (JP); Hirohide Satou, Komatsu (JP)

(73) Assignees: Komatsu Ltd., Tokyo (JP); Komatsu Industries Corp., Tokyo (JP)

( * ) Notice: Subject to any disclaimer, the term of this patent is extended or adjusted under 35 U.S.C. 154(b) by 566 days.

(21) Appl. No.: 11/794,935

(22) PCT Filed: Jan. 12, 2006

(86) PCT No.: PCT/JP2006/300289

§ 371 (c)(1),
(2), (4) Date: Jul. 9, 2007

(87) PCT Pub. No.: WO2006/075659

PCT Pub. Date: Jul. 20, 2006

(65) Prior Publication Data

US 2008/0141751 A1 Jun. 19, 2008

(30) Foreign Application Priority Data

Jan. 13, 2005 (JP) ..... 2005-006794

(51) Int. Cl.
*B21D 22/00* (2006.01)
*B21J 9/18* (2006.01)
*B30B 1/32* (2006.01)

(52) U.S. Cl. ..... 72/350; 72/453.13; 100/269.18; 100/918

(58) Field of Classification Search ..... 72/350, 72/351, 446, 453.13, 454, 455; 100/269.18, 100/918; 267/119, 130, 140, 152, 153; 248/633
See application file for complete search history.

(56) References Cited

U.S. PATENT DOCUMENTS 1,670,551 A * 5/1928 Rode ..... 72/351
1,779,093 A * 10/1930 Haverbeck ..... 72/351
5,419,169 A 5/1995 Kirii
(Continued)

FOREIGN PATENT DOCUMENTS

JP 5-285557 A 11/1993
(Continued)

OTHER PUBLICATIONS

Japanese Office Action dated Nov. 16, 2010 (and English translation thereof) in counterpart Japanese Application No. 2005-006794.

*Primary Examiner* — Teresa M Ekiert
(74) *Attorney, Agent, or Firm* — Holtz, Holtz, Goodman & Chick, PC

(57) ABSTRACT

A pressing machine 1 includes: a bed 6 on which a die-cushion device 10 is provided; and a bolster 51 provided on the bed 6. The bed 6 has an inner space 61 in which a die-cushion pad 13 of the die-cushion device 10 is lifted up and down. A supporting portion 63 penetrating the die-cushion pad 13 in a lifting direction and supporting a lower surface of the bolster 51 via a carrier 52 is provided in the inner space 61. With this arrangement, since the bolster 51 is supported by the supporting portion 63, the bolster 51 can be prevented from being flexed during a press forming operation, whereby a highly accurate press forming operation can be realized. In addition, since the supporting portion 63 penetrates the die-cushion pad 13, unlike conventional arrangements, the die-cushion pad 13 does not need to be divided, whereby a complication of the arrangement can be avoided.

6 Claims, 5 Drawing Sheets

U.S. PATENT DOCUMENTS

| | | | | | |
|---|---|---|---|---|---|
| 5,471,861 | A | * | 12/1995 | Kirii | |
| 5,540,073 | A | | 7/1996 | Kirii | |
| 5,660,074 | A | * | 8/1997 | Kaji | 72/350 |
| 6,101,861 | A | | 8/2000 | VanderZee et al. | |
| 2004/0094046 | A1 | * | 5/2004 | Aoshima et al. | |

FOREIGN PATENT DOCUMENTS

| | | | | |
|---|---|---|---|---|
| JP | 6-142996 | A | | 5/1994 |
| JP | 6-312225 | A | * | 11/1994 |
| JP | 7-100552 | A | * | 4/1995 |
| JP | 7-185692 | A | | 7/1995 |
| JP | 8-1247 | A | * | 1/1996 |
| JP | 10-85863 | A | | 4/1998 |
| JP | 10-166072 | A | * | 6/1998 |
| JP | 10-166191 | A | * | 6/1998 |
| JP | 10-202327 | A | * | 8/1998 |
| JP | 2002-501834 | T | | 1/2002 |
| WO | WO 99/38675 | A1 | | 8/1999 |

* cited by examiner

PRESSING MACHINE WITH DIE CUSHION DEVICE

This application is a U.S. National Phase Application under 35 USC 371 of International Application PCT/JP2006/300389 filed Jan. 12, 2006.

TECHNICAL FIELD

The present invention relates to a pressing machine having a die-cushion device.

BACKGROUND ART

A die-cushion device has been used in drawing-forming a workpiece with a pressing machine. The die-cushion device includes: a blank holder holding a workpiece against an upper die; a die-cushion pad for supporting the blank holder via a cushion pin; and a driving means for driving the die-cushion pad to be lifted in synchronization with a movement of a slide (see, for example, Patent Document 1).

[Patent Document 1] JP-A-10-202327

DISCLOSURE OF THE INVENTION

Problems to be Solved by the Invention

A lower die used in the pressing machine is attached to a platen-like bolster. However, a central part of the bolster may be slightly flexed downwardly due to a load applied during a forming operation. The flexure of the bolster has been a problem for conducting a highly accurate forming.

The problem is attributed to a structure of a bed on which the bolster is mounted. Specifically, the bed defines a space at a lower portion of the bolster in which a die-cushion pad of the die-cushion device is lifted up and down, so that no support is provided to a central part of a lower surface of the bolster.

The problem can be solved by providing, for example, a rib of a cross shape in plan view so as to partition the space of the bed, and arranging the bolster to be supported by an upper surface of the rib. In such an arrangement, however, since the die-cushion pad needs to be divided into four parts to be cross-shaped in order to avoid interfering with the rib, the arrangement may become complicated. Further, since each of divided pad parts is easily deformed by the load applied during the forming operation, the die-cushion pad may not be smoothly lifted down.

An object of the present invention is to provide a pressing machine having a die-cushion device that can simplify an arrangement and prevent the bolster from being flexed, whereby a press forming operation of a high accuracy can be realized.

Means for Solving the Problems

A pressing machine having a die-cushion device according to an aspect of the present invention includes: a bed on which the die-cushion device is provided; and a bolster provided on the bed, in which the bed has an inner space in which a die-cushion pad of the die-cushion device is lifted up and down, and a supporting portion penetrating the die-cushion pad in a lifting direction and supporting a lower surface of the bolster is provided in the inner space.

According to the aspect of the present invention, since the bolster is supported by the supporting portion, the bolster can be prevented from being flexed during the press forming operation, whereby a press forming operation of a high accuracy can be realized. In addition, since the supporting portion penetrates the die-cushion pad of the die cushion device, unlike the related arts, the die-cushion pad does not need to be divided, whereby a complication of the arrangement can be avoided.

In the pressing machine having a die-cushion device according to the aspect of the present invention, it is preferable that the supporting portion is provided at a position corresponding to a center of the lower surface of the bolster.

According to the aspect of the present invention, since the supporting portion is positioned at the center of the lower portion of the bolster, the center region of the bolster, which is the most vulnerable to flexure, can be effectively supported.

In the pressing machine having a die-cushion device according to the aspect of the present invention, it is preferable that a moving bolster is provided by the bolster and a carrier, the carrier being moved with the bolster mounted on, and the supporting portion supports the bolster via the carrier.

According to the aspect of the present invention, since the supporting portion supports the bolster via the carrier of the bolster, the supporting portion does not interfere with the carrier when the moving bolster is moved for replacing a die.

In the pressing machine having a die-cushion device according to the aspect of the present invention, it is preferable that the carrier includes a frame and a rib traversing an inner space of the frame, and the supporting portion supports the bolster via the rib.

According to the aspect of the present invention, since a portion supported by the supporting portion is provided with the rib reinforcing the frame, the frame is also prevented from being flexed during the press forming operation, whereby a press forming operation of a high accuracy can be reliably realized.

EXPLANATION OF CODES

1: pressing machine;
5: moving bolster;
6: bed;
10: die-cushion device;
13: die-cushion pad;
51: bolster;
52: carrier;
53: inner space;
54: rib;
55: frame;
61: inner space; and
63: supporting portion.

BEST MODE FOR CARRYING OUT THE INVENTION

An embodiment of the present invention will be described below with reference to the attached drawings.

Figure 1:
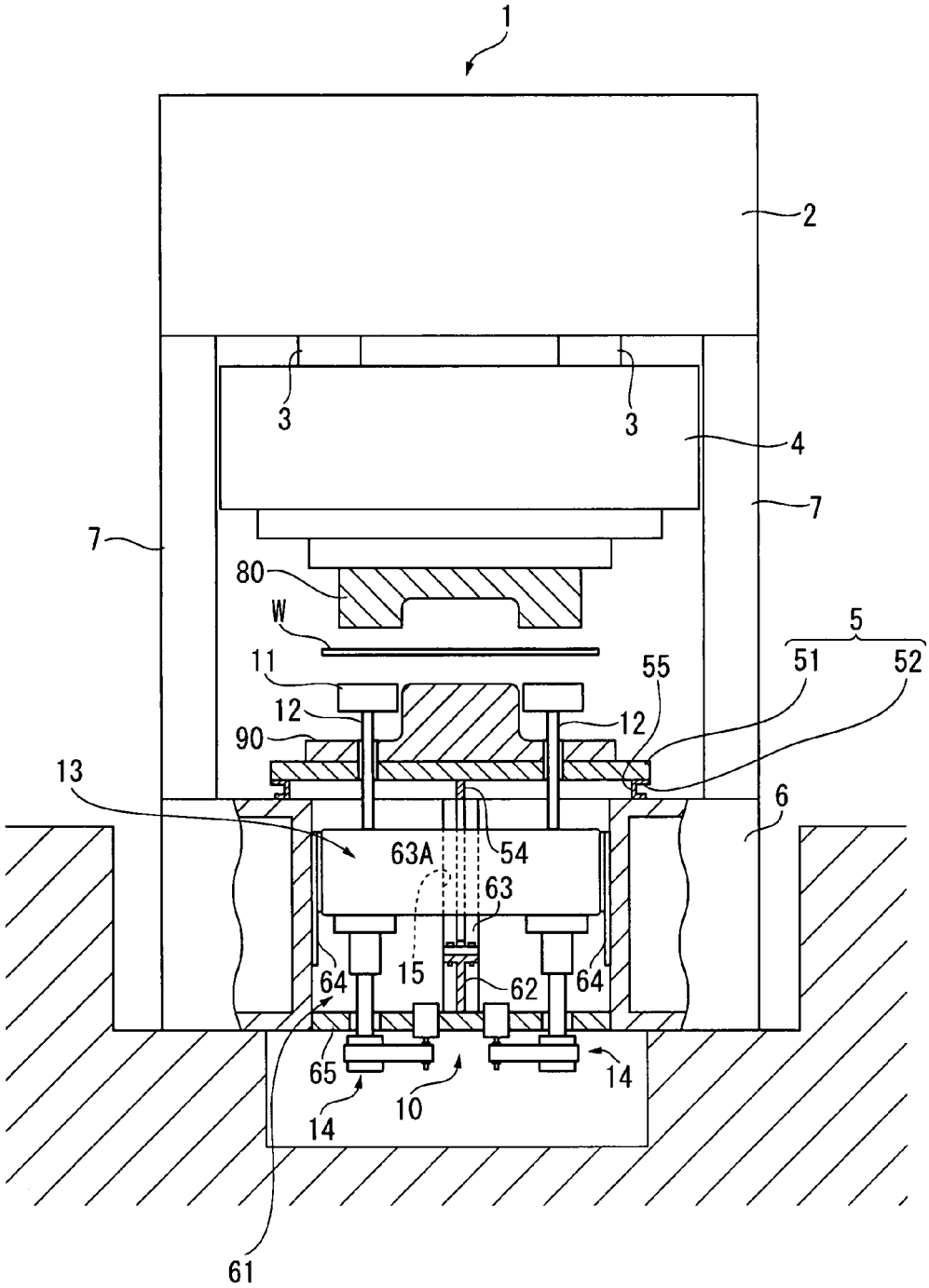
FIG. 1 is a schematic view showing an overall arrangement of a pressing machine according to an embodiment of the present invention.
Figure 2:
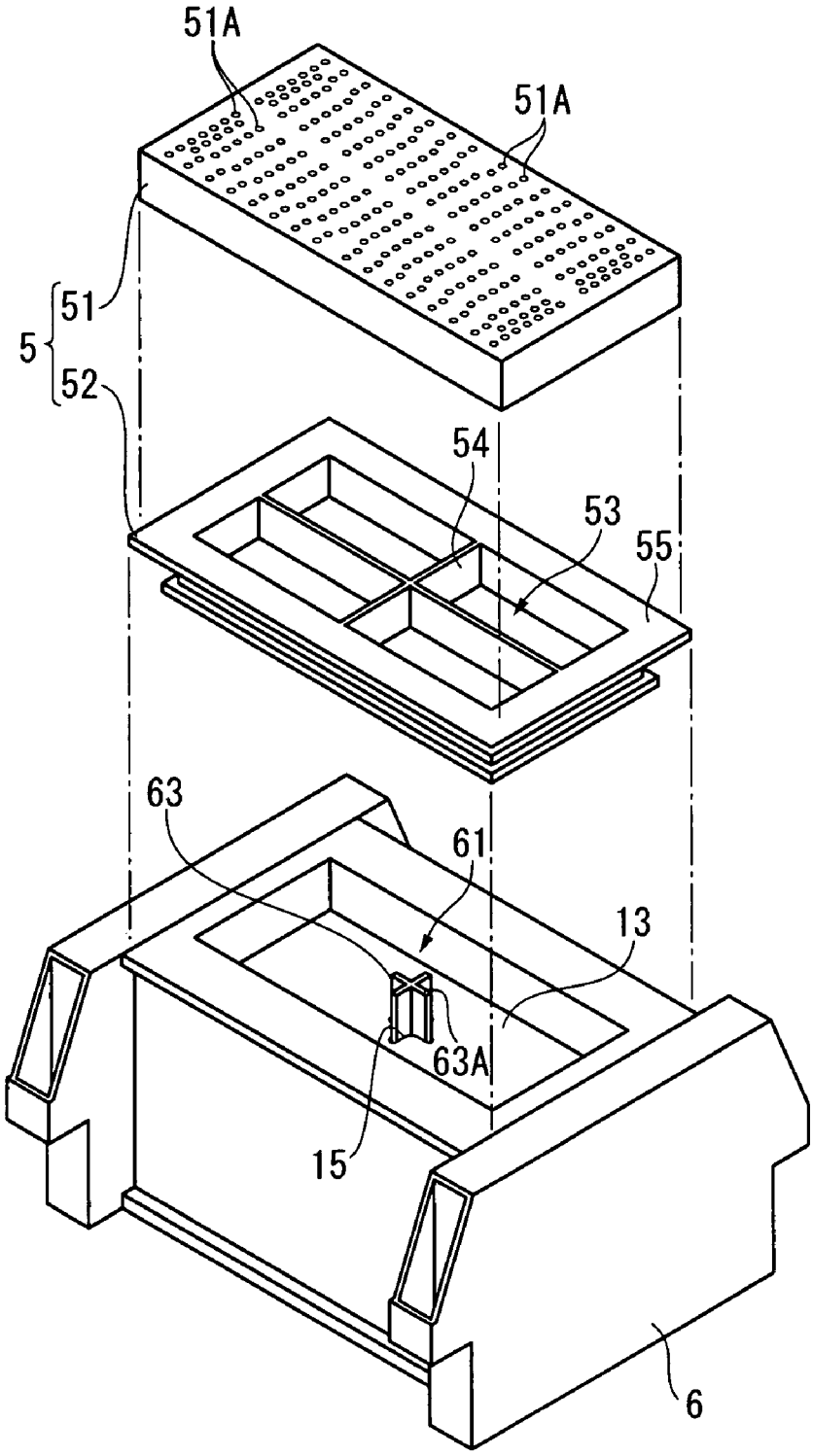
FIG. 2 is an exploded perspective view showing a primary portion of the pressing machine.
Figure 3:
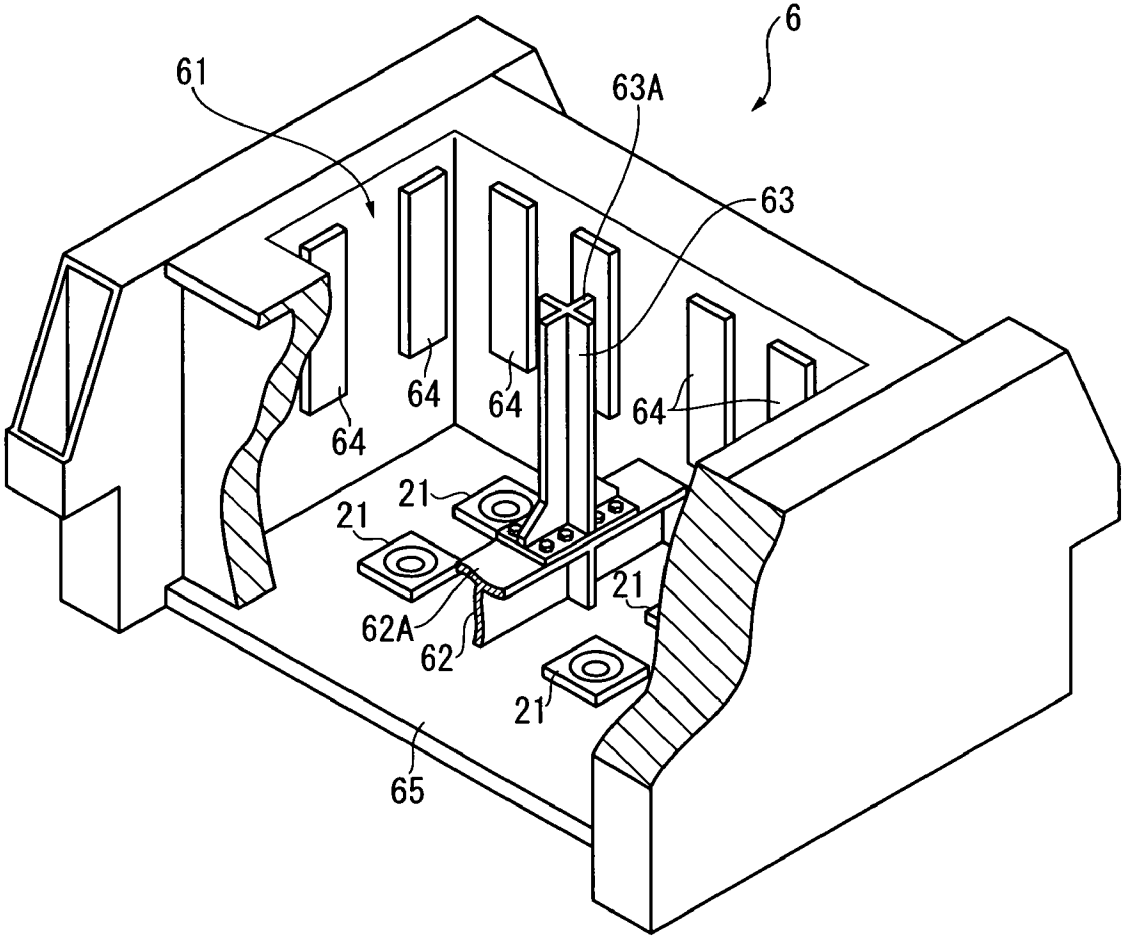
FIG. 3 is an enlarged view showing a primary portion of a bed of the pressing machine.

FIG. 1 is a schematic view showing an overall arrangement of a pressing machine 1 according to the present embodiment, FIG. 2 is an exploded perspective view showing a primary portion of the pressing machine 1, and FIG. 3 is an enlarged view showing a primary portion of a die-cushion device 10 mounted on the pressing machine 1.

The pressing machine 1 includes: a crown 2 having a built-in driving force transmission mechanism such as a crank mechanism, eccentric mechanism and link mechanism; a slide 4 connected to the driving force transmission mechanism inside the crown 2 via four plungers 3 (FIG. 1 shows only two of the plungers 3), an upper die 80 being attached on the slide 4; a bed 6 on which a moving bolster 5 attached with a lower die 91 is mounted; and four uprights 7 (FIG. 1 shows only two of the uprights) connecting the bed 6 and the crown 2. The die-cushion device 10 is housed inside the bed 6.

As shown in FIG. 2, the moving bolster 5 according to the present invention includes: a platen-like bolster 51 on which a number of penetrating holes 51A are formed; and a carrier 52 supporting the bolster 51. A cushion pin 12 (FIG. 1) employed in the die-cushion device 10 is inserted into the penetrating hole 51A of the bolster 51, and the penetrating hole 51A of the bolster 51 is selected in accordance with the lower die 90 to be used. The carrier 52 is provided with a moving means (not shown), which allows the bolster 51 to be moved outside the pressing machine 1 for a die replacement. The carrier 52 has a metal square frame 55, on which a rib 54 is provided such that the rib 54 partitions an inner space 53 into four parts in plan view. An upper surface of the rib 54 contacts a lower surface of the bolster 51, and a lower face of the rib 54 downwardly extends to a mounting surface with the bed 6.

On the other hand, as shown in FIGS. 1 and 3, the bed 6 is provided with an inner space 61 in which a die-cushion pad 13 (FIG. 1) of the die-cushion device 10 is lifted up and down. In FIG. 3, a rise portion 62 is provided on a floor portion 65 of the inner space 61 to traverse the center of the inner space 61, the rise portion 62 being T-shaped in cross section. A height of the rise portion 62 is set to be lower than that of a lowest position of the die-cushion pad 13, such that even when the die-cushion pad 13 is lifted down to the lowest position, the rise portion 62 does not collide with the die-cushion pad 13. On a center portion of a flat upper surface 62A of the rise portion 62, there is provided a supporting portion 63 of a cross shape in plan view erecting therefrom, which is fixed to the upper surface 62A, for example, by bolting.

Specifically, the supporting portion 63 is erected to penetrate the die-cushion pad 13, and an upper end surface 63A of the supporting portion 63 is formed to be flush with the mounting surface of the moving bolster 5 with the bed 6. The supporting portion 63 abuts from below on a cross portion of the rib 54 provided on the frame 55 of the carrier 52. In short, the supporting portion 63 supports the center of the lower surface of the bolster 51 via the rib 54 of the frame 55. With this arrangement, the frame 55 is reinforced by the rib 54 and the bolster 51 is prevented from being flexed during a press forming operation, whereby a press forming operation of a high accuracy can be realized. Size of the cross portion of the supporting portion 63 is determined based on, for instance, a forming load applied by the pressing machine 1, such that a flexure of the bolster 51 can be effectively prevented.

In the present embodiment, the moving means of the moving bolster 5 moves the bolster 51 as well as the carrier 52 to the outside the pressing machine 1, such that the die replacement is performed. However, since the supporting portion 63 does not protrude from an upper side of the bed 6, the supporting portion 63 does not interfere with the carrier 52. Accordingly, the moving bolster 5 can be moved smoothly.

Referring back to FIG. 1, the die-cushion device 10 includes: a blank holder 11 for holding a workpiece W against the upper die 80; the die-cushion pad 13 supporting the blank holder 11 via the cushion pin 12; and a driving means 14 driving the die-cushion pad 13, the driving means 14 being controlled to lift up and down the die-cushion pad 13, cushion pin 12 and blank holder 11 in synchronization with a movement of a slide while applying a upward biasing force to the members.

Figure 4:
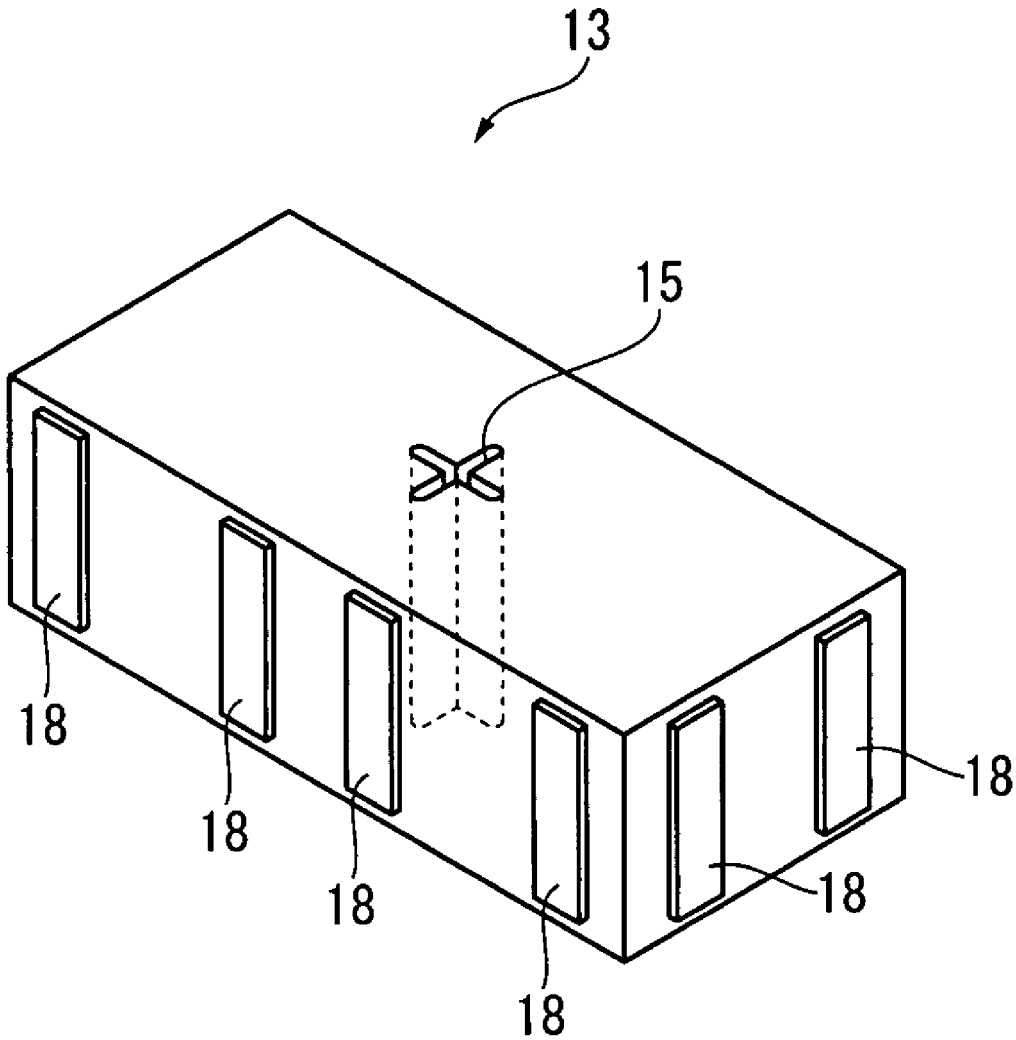
FIG. 4 is a perspective view showing a die-cushion pad of the die-cushion device.

As shown in FIGS. 1 and 4, in the die-cushion device 10, the die-cushion pad 13 is formed as a hollow rectangular metal box whose substantial entirety is housed inside the inner space 61 of the bed 6. A cross-shaped through-hole 15 into which the above-described supporting portion 63 is inserted is formed at the center of the die-cushion pad 13, the through-hole 15 penetrating upper and lower surfaces of the die-cushion pad 13. In assembling the die-cushion pad 13 into the bed 6 of the die cushion device, the die-cushion pad 13 is put into the inner space 61 from above. At the time of assembling, the supporting portion 63 is inserted into the though hole 15.

In short, unlike related arts, the die-cushion pad 13 is not divided into a plurality of parts, and the die-cushion pad 13 is lifted up and down with the supporting portion 63 penetrating the die-cushion pad 13. Accordingly, as compared with the related arts where the die-cushion pad is divided, the die-cushion pad 13 can be simply arranged. In addition, since a single large die-cushion pad 13 is employed, a deformation or the like of the die cushion 13 can be prevented in the press forming operation. Thus, the die-cushion pad 13 can be advantageously used in a press forming operation of a higher accuracy.

Guide plates 18 are provided on four circumferential lateral surfaces of the die-cushion pad 13. The guide plates 18 face guide plates 64 provided on inner walls of the inner space 61 of the bed 6, as shown in FIG. 3. The guide plates 18 and the guide plates 64 slide in contact with one another, and guide the lifting up and down of the die-cushion pad 13.

Figure 5:
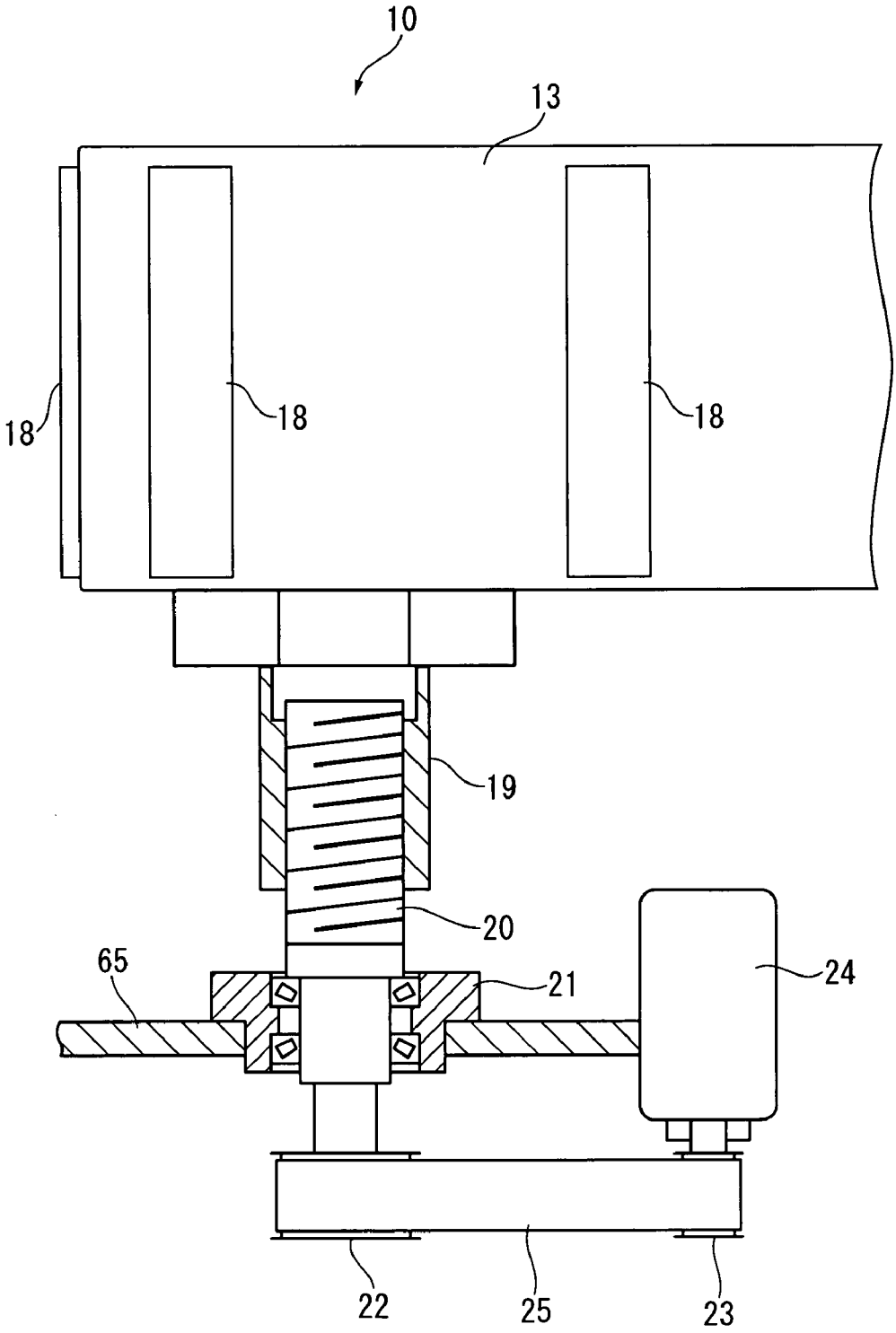
FIG. 5 is an enlarged view showing a driving means of the die-cushion device.

As shown in FIGS. 1 and 5, the driving means 14 provided to the die-cushion device 10 includes: a nut portion 19 provided on a lower side of the die-cushion pad 13; a ball screw portion 20 screwed to the nut portion 19; a shaft bearing member 21 provided on the floor portion 65 of the bed 6 to rotatably support a lower end side of the ball screw portion 20; a driven-side pulley 22 provided on a lower end of the ball screw portion 20; and a servo motor 24 having a drive-side pulley 23. In the driving means 14, the servo motor 24 is supported by an arbitrary portion such as the floor portion 65, and a belt 25 is wound around each of the pulleys 22, 23.

In the pressing machine 1 according to the present embodiment, where four plungers 3 are provided (four-point type machine), four of the driving means 14 are provided corresponding to each of the points. A rotation of each of the servo motors 24 is individually controlled by a controller. A rotation shaft of the servo motor 24 of the driving means 14 is forward-reverse rotated when electricity is supplied. Supplied with electricity, the rotation shaft of the servo motor 24 is rotated, and the drive-side pulley 23, the driven-side pulley 22 and ball screw portion 20 are rotated. In accordance with the rotation movement of the ball screw portion 20, the nut portion 19 is linearly moved in the lifting direction. Consequently, the die-cushion pad 13 is lifted up and down in conjunction with the nut portion 19. A cushion pressure (biasing force) applied to the die-cushion pad 13 is controlled by controlling the electric current supplied to the servo motor 24.

According to the present embodiment, as described above, since the bolster 51 is supported by the supporting portion 63 via the carrier 52, the bolster 51 can be prevented from being flexed during the press forming operation, whereby a press forming operation of a high accuracy can be realized. In addition, since the supporting portion 63 penetrates the die-cushion pad 13, unlike the related arts, the die-cushion pad 13 does not need to be divided, whereby a complication of the arrangement can be avoided. Since the supporting portion 63 is positioned at the center of the lower portion of the bolster 51, the center region of the bolster 51, which is the most vulnerable to flexure, can be effectively supported.

Incidentally, the present invention is not limited to the embodiment described above, but includes other arrangements as long as an object of the present invention can be achieved, which includes the following modification.

For example, in the above-described embodiment, although the supporting portion 63 is cross-shaped in plan view, the shape is not limited thereto. The supporting portion 63 may be of any shape such as H-shape or tubular shape.

In the above-described embodiment, although a single supporting portion 63 is provided, the supporting portion 63 may be provided in plurality, and the number may be arbitrarily determined. Accordingly, the supporting portion may be provided with the number being equivalent to the number of the points.

When a plurality of supporting portions are provided, supporting positions of the supporting portions may be determined considering the number of the supporting portions.

In the above-described embodiment, the die-cushion pad 13 is driven by the servo motor 24, but the die-cushion pad 13 may be driven by a hydraulic actuator, pneumatic actuator and any driving source.

The number of the driving means 14 may be determined in any manner, which does not need to be equivalent to the number of the points.

Although the best arrangement and method for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

Therefore, the description that limits the shape and the material, especially of the supporting portion 63, is only an example to make the invention easily understood, but is not intended to limit the invention, so that the invention includes the description using a name of component without a part of or all of the limitation on the shape and the material etc.

INDUSTRIAL APPLICABILITY

The present invention is applicable to a pressing machine equipped with a die-cushion device having a die-cushion pad.

What is claimed is:

1. A pressing machine having a die-cushion device, comprising:

a bed on which the die-cushion device is provided, the bed having an inner space in which a die cushion pad of the die-cushion device is liftable up and down;

a bolster provided on the bed and having a lower surface opposed to the inner space;

a rise portion provided on a floor portion of the inner space; and a supporting portion fixed an upper surface of the rise portion and supporting the lower surface of the bolster with an upper surface of the supporting portion, wherein the supporting portion is provided in the inner space and penetrates the die-cushion pad in a lifting direction so that the die cushion pad is movable while the supporting portion is stationary.

2. The pressing machine having a die-cushion device according to claim 1, wherein the supporting portion is provided at a position corresponding to a center of the lower surface of the bolster.

3. The pressing machine having a die-cushion device according to claim 2, wherein a moving bolster is provided by the bolster and a carrier, the carrier being moved with the bolster mounted on, and the supporting portion supports the bolster with the upper surface of the supporting portion via the carrier.

4. The pressing machine having a die-cushion device according to claim 3, wherein the carrier includes a frame and a rib traversing an inner space of the frame and extending downwardly to a mounting surface with the bed, the rib having an upper surface contacting the lower surface of the bolster and a lower surface contacting the upper surface of the supporting portion, and wherein the supporting portion supports the bolster via the rib.

5. The pressing machine having a die-cushion device according to claim 1, wherein a moving bolster is provided by the bolster and a carrier, the carrier being moved with the bolster mounted on, and the supporting portion supports the bolster with the upper surface of the supporting portion via the carrier.

6. The pressing machine having a die-cushion device according to claim 5, wherein the carrier includes a frame and a rib traversing an inner space of the frame and extending downwardly to a mounting surface with the bed, the rib having an upper surface contacting the lower surface of the bolster and a lower surface contacting the upper surface of the supporting portion, and wherein the supporting portion supports the bolster via the rib.

* * * * *